US010381154B2

(12) United States Patent
Watanabe et al.

(10) Patent No.: US 10,381,154 B2
(45) Date of Patent: Aug. 13, 2019

(54) HIGH-VOLTAGE AND HIGH-FREQUENCY INSULATION TRANSFORMER

(71) Applicant: FUJI ELECTRIC CO., LTD., Kawasaki-shi, Kanagawa (JP)

(72) Inventors: Takeshi Watanabe, Hino (JP); Kenji Okamoto, Hachioji (JP); Tatsuya Ganbe, Asaka (JP)

(73) Assignee: FUJI ELECTRIC CO., LTD., Kawasaki-Shi, Kanagawa (JP)

( * ) Notice: Subject to any disclaimer, the term of this patent is extended or adjusted under 35 U.S.C. 154(b) by 0 days.

(21) Appl. No.: 15/583,954

(22) Filed: May 1, 2017

(65) Prior Publication Data

US 2017/0365400 A1 Dec. 21, 2017

(30) Foreign Application Priority Data

Jun. 16, 2016 (JP) ..... 2016-120231

(51) Int. Cl.
*H01F 5/02* (2006.01)
*H01F 27/32* (2006.01)
*H01F 27/28* (2006.01)

(52) U.S. Cl.
CPC ..... *H01F 27/325* (2013.01); *H01F 27/2823* (2013.01); *H01F 27/327* (2013.01)

(58) Field of Classification Search
CPC ..... H05F 5/02; H05F 5/06; H01F 2005/022; H01F 2005/025; H01F 2005/027; H01F 2005/046; H01F 27/2866; H01F 27/28; H01F 27/32; H01F 27/323; H01F 27/324; H01F 27/327; H01F 27/325; H01F 27/2823; H01F 27/2847
USPC ..... 336/198, 208, 212, 221, 205, 170
See application file for complete search history.

(56) References Cited

U.S. PATENT DOCUMENTS 3,308,414 A * 3/1967 Ostrander ..... H01B 3/085 174/110 R
6,310,533 B2 * 10/2001 Coulombier ..... H01F 7/128 336/205
8,680,961 B2 * 3/2014 Yokota ..... H01F 27/022 336/212
8,922,320 B2 * 12/2014 Eom ..... H01F 27/325 336/192
9,349,521 B2 * 5/2016 Tsai ..... H01F 27/28
2005/0219029 A1 * 10/2005 Watanabe ..... H01F 27/022 336/208
2009/0278648 A1 * 11/2009 Teng ..... H01F 27/2866 336/199
2011/0115598 A1 * 5/2011 Wu ..... H01F 27/325 336/212

(Continued)

FOREIGN PATENT DOCUMENTS

JP H09-045550 A 2/1997

*Primary Examiner* — Mang Tin Bik Lian
(74) *Attorney, Agent, or Firm* — Rabin & Berdo, P.C.

(57) ABSTRACT

A transformer is configured to include a pair of cores that each have an inner leg, wherein a primary winding that is wound around a bobbin having a hollow into which the inner legs of the cores are inserted and that is hermetically sealed with resin material, and a secondary winding that has a hollow into which the inner legs of the cores are inserted and that is constituted of a conductor formed by die-cutting a metal plate into a ring are dispersedly arranged over the inner legs of the cores.

15 Claims, 5 Drawing Sheets

(56) References Cited

U.S. PATENT DOCUMENTS

| | | | | |
|---|---|---|---|---|
| 2013/0107580 | A1* | 5/2013 | Inaba | H01F 27/306 363/16 |
| 2014/0062642 | A1* | 3/2014 | Lin | H01F 27/2847 336/196 |
| 2014/0125444 | A1* | 5/2014 | Zhang | H01F 27/2847 336/198 |
| 2015/0318098 | A1* | 11/2015 | Miyamoto | H01F 30/00 336/183 |
| 2015/0357111 | A1* | 12/2015 | Sasaki | H01F 27/266 336/198 |

* cited by examiner

HIGH-VOLTAGE AND HIGH-FREQUENCY INSULATION TRANSFORMER

CROSS-REFERENCE TO RELATED APPLICATIONS

This application is based upon and claims the benefit of priority of the prior Japanese Patent Application No. 2016-120231, filed on Jun. 16, 2016, the entire contents of which are incorporated herein by reference.

FIELD

The present invention relates to a high-voltage and high-frequency insulation transformer used in a switching power supply that is used in various electronic devices.

BACKGROUND

With the development of the information society, there has been an increase in power consumed by IT (information technology) equipment. Thus, there has been a need for a power supply system that directly receives power at a high voltage without using a power-reception transformer in order to make power supply facilities simple, and that converts the received power into a low-voltage DC voltage not greater than 100 [V] to output it.

In order to realize such a power supply system and make the power supply system smaller, a high-voltage and high-frequency insulation transformer is indispensable.

As a structure of a conventional typical high-frequency transformer, Japanese Laid-open Patent Publication No. 9-045550 discloses a structure in which a primary winding and a secondary winding are wound one over another around a shared bobbin and an insulating cover is covered to improve insulation between a ferrite core and a winding.

SUMMARY

A high-voltage and high-frequency insulation transformer according to an aspect of the present invention includes a plurality of windings that are wound and provided in legs of cores, and a bobbin formed of resin material having a low dielectric constant and high insulating properties, wherein, from among the plurality of windings, a winding to which a high voltage is applied is wound around the bobbin and is hermetically sealed with insulating resin, so as to be integrally formed with the bobbin.

In the high-voltage and high-frequency insulation transformer according to the aspect described above, it is preferable that thermosetting resin having a low dielectric constant be used as resin material of which the bobbin is formed and as insulating resin with which the winding is sealed hermetically.

Further, in the high-voltage and high-frequency insulation transformer in the aspect of the present invention described above, it is preferable that thermoplastic resin that has a low dielectric constant and is resistant to heat be used as resin material of which the bobbin is formed and as insulating resin with which the winding is sealed hermetically.

DETAILED DESCRIPTION

Embodiments of the present invention will now be described in detail with reference to the drawings.

The conventional high-frequency transformer described in Japanese Laid-open Patent Publication No. 9-045550 has a complicated configuration for ensuring insulation, and it takes a long time to manufacture it. Further, the primary winding and the secondary winding are situated closely to each other, so a partial discharge will occur between the primary and secondary windings if a high voltage is applied to one of the windings.

Thus, a transformer is provided that is suitable for a high-voltage and high-frequency drive, and in particular, a high-voltage and high-frequency insulation transformer is provided that can be manufactured easily and makes it possible to improve dielectric strengths between a winding to which a high voltage is applied and a core, and between the windings to which a high voltage is applied and another winding.

Figure 1:
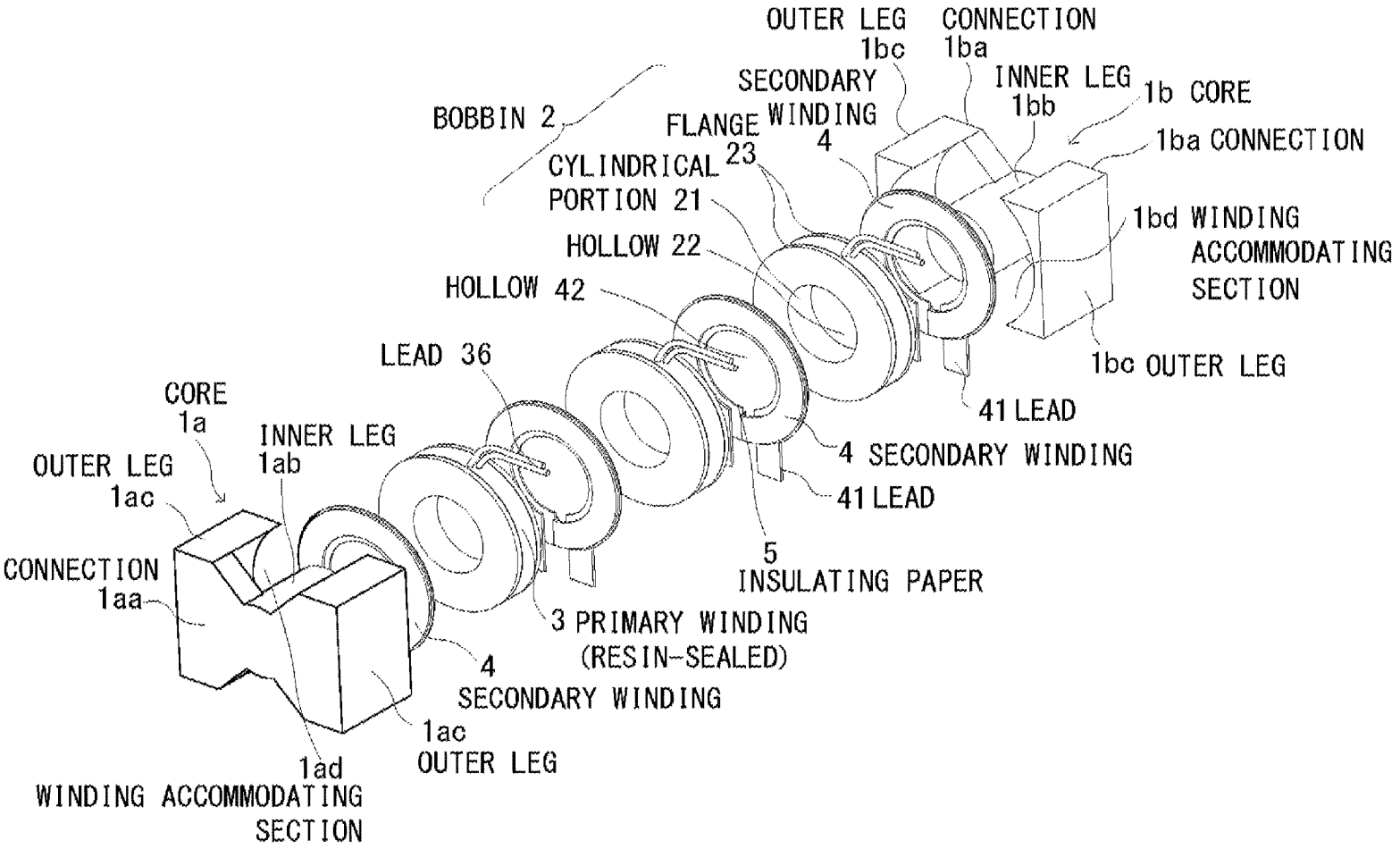
FIG. 1 is an exploded perspective view of a configuration of a high-voltage and high-frequency insulation transformer according to embodiments of the present invention.
Figure 2:
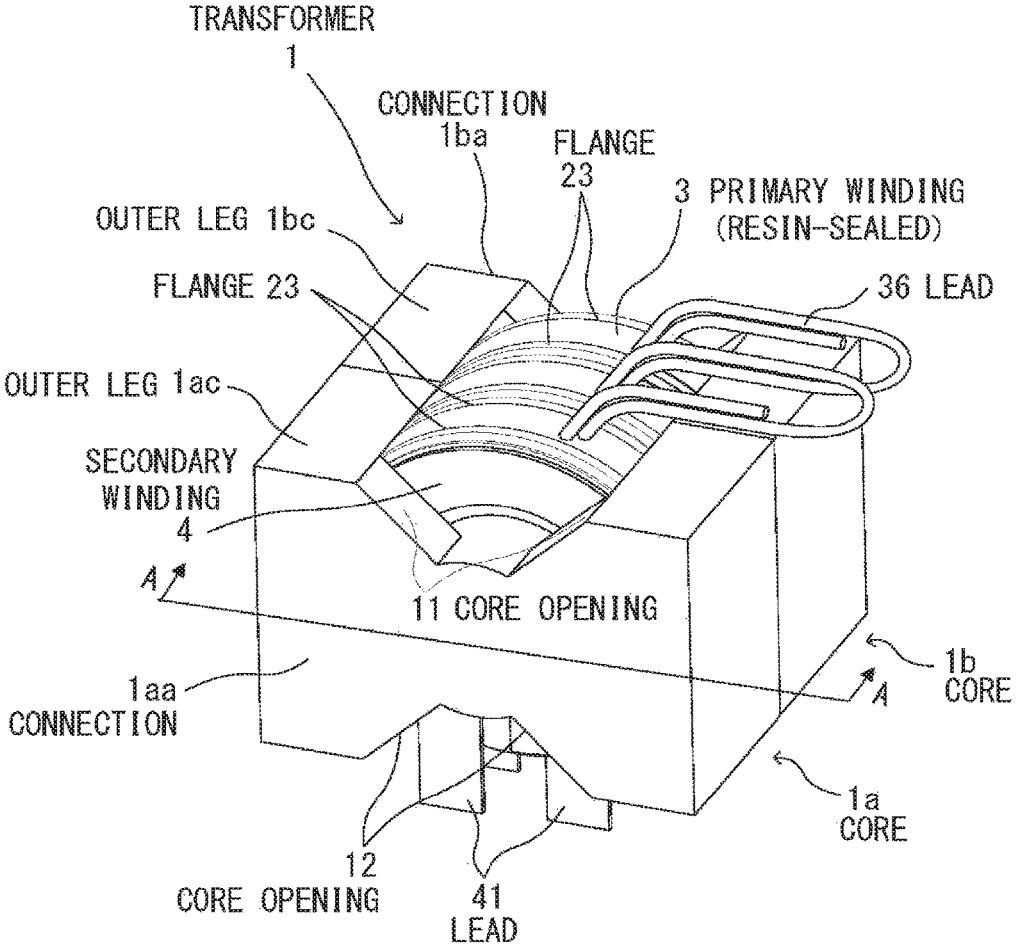
FIG. 2 is a perspective view of the configuration of the high-voltage and high-frequency insulation transformer according to the embodiments of the present invention.

FIG. 1 is an exploded perspective view of a configuration of a high-voltage and high-frequency insulation transformer according to embodiments of the present invention. FIG. 2 is a perspective view of the assembled high-voltage and high-frequency insulation transformer according to the embodiments of the present invention. Using FIGS. 1 and 2, the configuration of the high-voltage and high-frequency insulation transformer according to the embodiments of the present invention is described in detail. The high-voltage and high-frequency insulation transformer will hereinafter also be referred to as a transformer.

The transformer illustrated in FIG. 1 (a transformer 1 illustrated in FIG. 2) is constituted of a pair of cores 1*a* and 1*b*, three primary windings 3, and four secondary windings 4.

The transformer 1 electrically insulates a high-voltage and high-frequency AC voltage applied to the primary winding 3, and outputs a low-voltage and high-frequency AC voltage to the secondary winding 4. Thus, a low current flows through the primary winding 3 and a high current flows through the secondary winding 4.

The transformer 1 is implemented on a printed circuit board (not illustrated). The primary winding 3 may hereinafter include a primary winding integrally formed with a bobbin 2.

In FIG. 1, the cores 1*a* and 1*b* in pairs are PQ-type ferrite cores. The core 1*a* includes a column-shaped inner leg 1*ab*, a pair of outer legs 1*ac*, and a connection 1*aa* that connects the inner leg 1*ab* to the pair of outer legs 1*ac*. A space formed between the pair of outer legs 1*ac* and the inner leg 1*ab* is a winding accommodating section 1*ad* that accommodates the primary windings 3 and the secondary windings 4.

Likewise, the core 1*b* includes a column-shaped inner leg 1*bb*, a pair of outer legs 1*bc*, and a connection 1*ba* that connects the inner leg 1*bb* to the pair of outer legs 1*bc*. A space formed between the pair of outer legs 1*bc* and the inner leg 1*bb* is a winding accommodating section 1*bd* that accommodates the primary windings 3 and the secondary windings 4.

An electrical wire is wound around the bobbin 2 a predetermined number of times so that the primary winding 3 is integrally configured with the bobbin 2.

The bobbin 2 is formed of resin material, and includes a cylindrical portion 21 having a hollow 22, and circular-flat-plate-shaped flanges 23 that respectively extend from two ends of the cylindrical portion 21. The flange 23 of the bobbin 2 is formed to have a height greater than the width of the cylindrical portion 21.

In other words, the bobbin 2 has a thin circular flat plate shape and is formed to be in the shape of a spool that includes the flanges 23 each having a height larger than the width of the cylindrical portion 21.

The bobbin 2 in the shape described above can easily be molded by pouring resin material into a mold. Further, the bobbin 2 can also be formed by milling it from resin material.

The resin material of which the bobbin 2 is formed is resin having a low dielectric constant and high insulating properties. The resin material will be described in detail later.

The primary winding 3 is wound around the cylindrical portion 21 of the bobbin 2. A winding height of the primary winding 3 wound a predetermined number of times is smaller than the height of the flange 23. In a space formed by the cylindrical portion 21 and the flanges 23, the primary winding 3 is covered with an insulating resin material so as to be hermetically sealed with it.

This permits the primary winding 3 and the bobbin 2 to be easily integrally formed. It is preferable that resin material with which the primary winding 3 is sealed hermetically be a material identical to the resin material of which the bobbin 2 is formed.

In FIG. 1, the primary winding wound around the bobbin 2 is covered with the flanges 23 of the bobbin 2 and the resin with which the primary winding has been sealed hermetically, and is not situated outside of the bobbin 2. Primary-winding leads 36 are led through the beginning of winding and the end of winding of the primary winding.

The secondary winding 4 is constituted of two conductor plates having a thickness of a few hundred [μm]. The two conductor plates are in the shape of a ring with a gap (not illustrated), wherein a hollow 42 is provided at the center of the ring and a lead 41 is provided at one of the ring ends forming the gap.

Then, the two rings are superimposed on each other such that the leads 41 of the two rings do not overlap, and the other ends of the two rings are then soldered together. Accordingly, a spiral secondary winding 4 with two turns is configured. An insulating paper 5 is inserted between the two conductor plates.

The conductor plate in the ring shape described above can easily be manufactured by, for example, die-cutting a metal plate such as a copperplate having a high electrical conductivity, using, for example, a press. The example in which the number of conductor plates that configure the secondary winding 4 is two has been described above, but this is just an example, and the number of conductor plates may be one or more than two.

Next, the configuration of the transformer 1 illustrated in FIG. 1 is described below.

The primary winding 3 and the secondary winding 4 are arranged in a layered formation alternately, in order of the secondary winding 4, the primary winding 3, the secondary winding 4, the primary winding 3, the secondary winding 4, the primary winding 3, and the secondary winding 4, wherein the hollows 22 and 42 align.

The cores 1*a* and 1*b* are arranged such that the pairs of outer legs 1*ac* and 1*bc* face each other and the inner legs 1*ab* and 1*bb* face each other, wherein the primary windings 3 and the secondary windings 4 that are arranged in a layered formation are situated between the cores 1*a* and 1*b*.

The inner legs 1*ab* and 1*bb* of the cores 1*a* and 1*b* are inserted into the hollow 42 of the secondary winding 4 and the hollow of the primary winding 3 (the hollow 22 of the bobbin 2), and their end faces are in contact with each other. The end faces of the pairs of outer legs 1*ac* and 1*bc* of the cores 1*a* and 1*b* are also in contact with each other.

In the transformer 1 configured as described above, a magnetic path is formed by the inner legs 1*ab* and 1*bb* and the pairs of outer legs 1*ac* and 1*bc* of the cores 1*a* and 1*b*, as illustrated in FIG. 2. Then, the primary winding 3 and the secondary winding 4 into which the inner legs 1*ab* and 1*bb* have been inserted are accommodated and fixed in the winding accommodating sections 1*ad* and 1*bd*.

The primary winding 3 is hermetically sealed with insulating resin within the bobbin 2. Thus, in FIG. 2, the primary winding 3 itself is not seen, and the resin with which the primary winding 3 has been sealed hermetically is seen.

The primary winding 3 includes the leads 36 which are led outside of the bobbin 2 from the hermetically sealed portion of the primary winding 3. In other words, the primary-winding lead 36 is led upward from an opening 11 on the upper side of the cores 1*a* and 1*b*.

Thus, heat generated in the primary winding 3 is transmitted to the primary-winding lead 36 and released to the outside air through the primary-winding lead 36. However, a current value that flows through the primary winding 3 is small, so an amount of heat generated in the primary winding 3 is small. Thus, there is a slight increase in temperature due to heat generation in a primary winding.

The secondary-winding lead 41 is led downward from an opening 12 on the lower side of the pair of cores 1*a* and 1*b*. The lead 41 is soldered to the printed circuit board (not illustrated). The position of the secondary winding 4 is fixed in the pair of cores 1*a* and 1*b* by the lead 41 being soldered to the printed circuit board.

The amount of heat generation in the secondary winding 4 through which a high current flows is large. The heat generated in the secondary winding 4 is released to the outside air through the lead 41 led below the cores 1*a* and 1*b*.

The configuration includes four separate secondary windings 4, so heat generation is dispersed and heat is released effectively at the leads 41 of each of the secondary windings 4. This results in suppressing a local overheating in the secondary winding 4.

Further, the primary-winding lead 36 is led above the transformer 1, and the secondary-winding lead 41 is led below the transformer.

Thus, the clearance and the creepage distance between the primary-winding lead 36 and the secondary-winding lead 41 are sufficiently ensured. As a result, the insulation between the primary-winding lead 36 and the secondary-winding lead 41 is sufficiently ensured.

Figure 3:
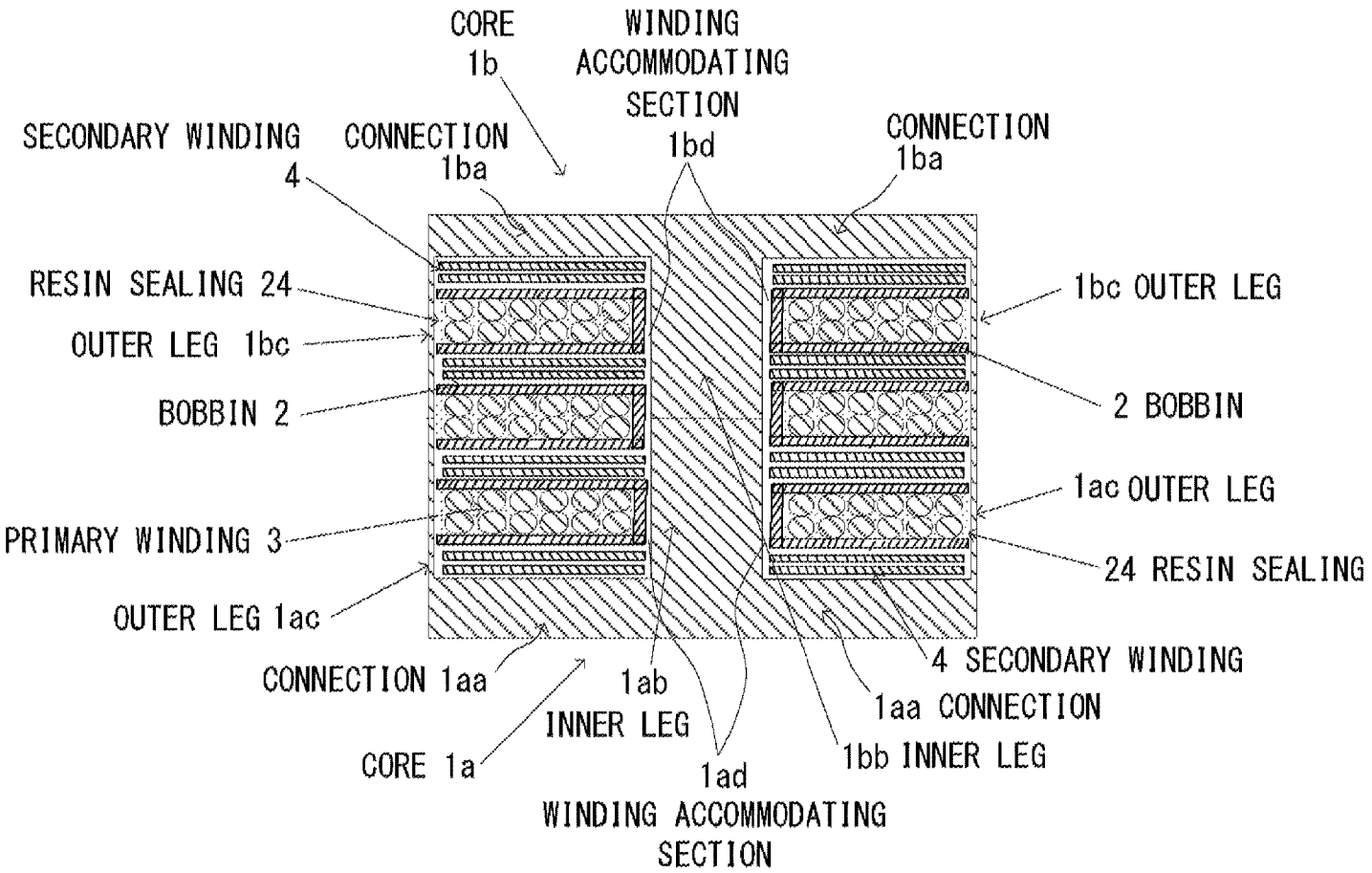
FIG. 3 is a cross-sectional view of the high-voltage and high-frequency insulation transformer, as cut in a horizontal direction along line A-A of FIG. 2.

FIG. 3 is a cross-sectional view of the transformer 1 along line A-A of FIG. 2, as viewed from above.

As illustrated in FIG. 3, the transformer 1 is constituted of the pair of cores 1*a* and 1*b*, the three primary windings 3, and the four secondary windings 4. The cores 1*a* and 1*b* are arranged such that the end faces of their inner legs 1*ab* and 1*bb* are in contact with each other and the end faces of their pairs of outer legs 1*ac* and 1*bc* are in contact with each other. A space formed by the inner leg 1*ab*, 1*bb* and the pair of outer legs 1*ac*, 1*bc* is the winding accommodating section 1*ad*, 1*bd*.

The primary winding 3 and the secondary winding 4 are in close contact with one another and arranged in a layered formation within the winding accommodating section 1*ad*, 1*bd*, in order of the secondary winding 4, the primary winding 3, the secondary winding 4, and so on.

Further, the inner legs 1*ab* and 1*bb* of the cores 1*a* and 1*b* are inserted into the hollow 22 of the primary winding 3 (the bobbin 2) and the hollow 42 of the secondary winding 4. Accordingly, the primary winding 3 is arranged closely to the secondary winding 4 and the cores 1*a* and 1*b*.

However, as illustrated in FIG. 3, the primary winding 3 is hermetically sealed with resin material identical to that of the bobbin 2 within the bobbin 2 formed of resin material that exhibits a high dielectric strength. Thus, the primary winding 3 has a sufficient dielectric strength with respect to the secondary winding 4 and the cores 1*a* and 1*b*.

This will be described using FIG. 4.

Figure 4:
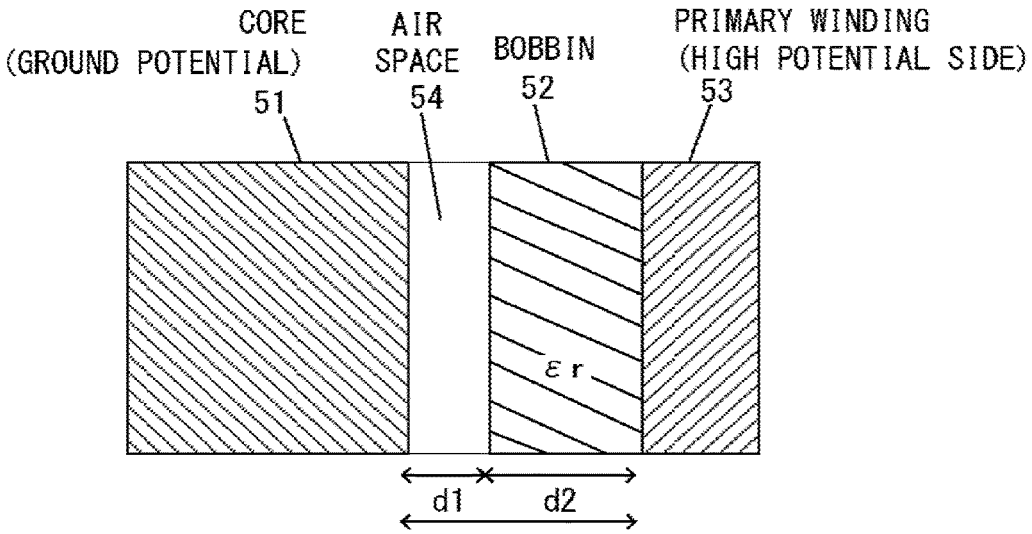
FIG. 4 illustrates a two-layer dielectric model in the high-voltage and high-frequency insulation transformer.

FIG. 4 illustrates a two-layer dielectric model in the high-voltage and high-frequency insulation transformer. The figure schematically illustrates a structure of a transformer constituted of a core 51 that is connected to a ground potential and a primary winding 53 that is wound around a bobbin 52 and connected to the high-potential side. There exists an air space 54 of a thickness $d_1$ between the core 51 and the bobbin 52. The bobbin 52 is formed of insulating material with a relative dielectric constant $\varepsilon_r$, and has a thickness $d_2$.

Using this two-layer dielectric model, a mechanism by which a partial discharge that occurs between the primary winding 3 and the core 1*a*, 1*b* is suppressed is described. A mechanism by which a partial discharge that occurs between the primary winding 3 and the secondary winding 4 is suppressed is similar.

A partial discharge inception voltage $V_{pd}$ in the two-layer dielectric model illustrated in FIG. 4 is obtained using Formula (1) below.

$$V_{pd}=\{d_1+(d_2/\varepsilon_r)\}\cdot V_p/d_1 \quad (1)$$

Here, $V_{pd}$ represents a partial discharge inception voltage [Vrms], $V_p$ represents a Paschen voltage [Vrms], $d_1$ represents a thickness of the air space [m], $d_2$ represents a thickness of an insulator (bobbin) [m], and $\varepsilon_r$ represents a relative dielectric constant of the insulator (bobbin).

In FIG. 4, when a voltage burden in the air space 54 that exists between the primary winding 53 on the high potential side and the core 51 on the low potential side (earth potential) is heavy, a partial discharge occurs between these parts.

However, in the embodiments of the present invention, the bobbin 2 is formed of insulating resin material having a low dielectric constant. The primary winding 3 is wound around the cylindrical portion 21 of the bobbin 2 and sealed hermetically, so as to be integrally configured with the bobbin 2. In other words, the primary winding 3 is hermetically sealed with insulating resin material having a thickness d2 and a low dielectric constant. The thickness d2 of the insulating resin material with which the primary winding 3 is sealed hermetically is a thickness that satisfies a predetermined partial discharge inception voltage $V_{pd}$ in Formula (1).

This permits a reduction in the voltage burden in an air space (corresponding to the air space 54 of FIG. 4) that exists between the primary winding 3 at high potential which is hermetically sealed with insulating resin and the core 1*a*, 1*b* at low potential (earth potential). Thus, the occurrence of a partial discharge between the primary winding 3 and core 1*a*, 1*b* is suppressed.

In other words, in the high-voltage and high-frequency insulation transformer according to the embodiments of the present invention, the primary winding 3 to which a high voltage is applied is hermetically sealed within the bobbin that is formed of insulating resin material having a low dielectric constant, which results in being able to obtain a larger value of the partial discharge inception voltage $V_{pd}$ in Formula (1) above. This permits a suppression of the occurrence of a partial discharge between the primary winding 3 and the core 1*a*, 1*b*.

Figure 5:
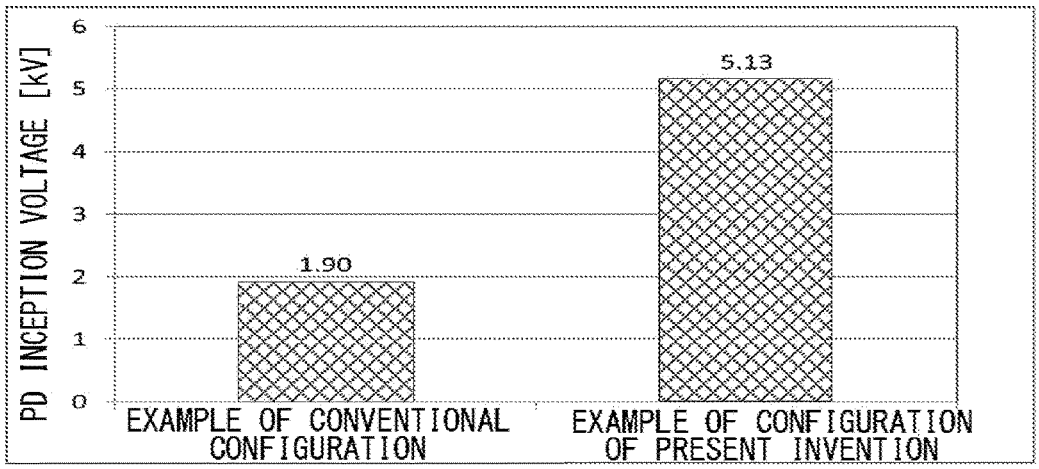
FIG. 5 is a graph that illustrates a result of a partial discharge test of a high-frequency insulation transformers with respect to a conventional structure and a structure of the present invention.

FIG. 5 is a graph that illustrates a result of a partial discharge test of a high-frequency insulation transformer with respect to a conventional structure and a structure of the present invention. The high-frequency insulation transformer having the conventional structure is a transformer that is configured by winding a primary winding and a secondary winding around a generally used bobbin made of phenolic resin.

Using a typical commercial power supply of an alternating current of 50 [Hz], a partial discharge is measured on the basis of the method for measuring the partial discharge characteristics in order to measure an inception voltage of a partial discharge that occurs between a "primary winding" and a "core member or secondary winding", the method for measuring the partial discharge characteristics being specified in JEC-0401 (Japanese Electrotechnical Committee, The Institute of Electrical Engineers of Japan).

As can be seen from FIG. 5, the partial discharge inception voltage of the high-frequency insulation transformer having the structure of the present invention is 5.13 [kV], whereas the partial discharge inception voltage of the high-frequency transformer having the conventional structure is 1.90 [kV].

From the comparison above, it can be seen that there is a significant improvement (increase) in the partial discharge inception voltage in the high-frequency insulation transformer having the structure of the present invention.

The bobbin 2 used in the high-frequency insulation transformer of the embodiments of the present invention is formed of olefinic-cross-link-type thermosetting resin (such as dicyclopentadiene resin) that has a dielectric constant not greater than 3.0 and is resistant to heat. Further, a hermetical sealing of the primary winding within the bobbin 2 is also performed using this resin material.

In addition to the resin material described above, thermoplastic resin that has a low dielectric constant and is resistant to heat, such as fluorocarbon resin (e.g., Teflon™) typified by PTFE (polytetrafluoroethylene) and polystyrenic resin, can also be used as a material for forming the bobbin 2 and for hermetically sealing the primary winding.

PS (polystyrene), PE (polystyrene), ABS (styrene-butadiene-acrylonitrile copolymer), and AS (styrene-acrylonitrile copolymer) are typical examples of polystyrenic resin.

In the embodiment described above, the high-voltage and high-frequency transformer in which a high voltage is applied to the primary winding 3 and a low voltage is output from the secondary winding has been described as an example, in order to explain an insulating structure of a winding to which a high voltage is applied. However, the present invention is not limited to the high-voltage, high-frequency transformer described above.

In other words, the present invention is applicable to an insulating structure of a secondary winding in a high-voltage and high-frequency transformer in which a low voltage is applied to the primary winding 3 and a high voltage is output from the secondary winding.

The present invention is also applicable to an insulating structure of a primary winding and a secondary winding in a high-voltage and high-frequency transformer in which a high voltage is applied to the primary winding 3 and a high voltage is output from the secondary winding.

In the present embodiment, the transformer in which the primary and secondary windings are wound and provided in the inner legs of the PQ cores has been described as an example in order to explain an insulating structure of a winding.

However, the present invention is not limited to the transformer configured using the PQ cores. In other words, the present invention is applicable to a transformer configured using cores in another form such as EE cores or EI cores.

Further, the present invention is not limited to the high-frequency transformer in which the primary and secondary windings are wound and provided in the inner legs of the cores. In other words, the present invention is applicable to a transformer in which primary and secondary windings are wound around legs that form a magnetic path, such as side legs of cores.

Furthermore, the high-frequency transformer has been described as an example in order to explain the insulating structure of the transformer 1. However, the present invention is not limited to the insulating structure of a transformer.

In other words, the present invention is applicable to an inductor configured by providing, in cores, a bobbin around which windings are wound.

According to the embodiment described above, it is possible to provide a high-voltage and high-frequency insulation transformer that can be easily manufactured but can ensure a dielectric strength with respect to a high voltage, because a winding to which a high voltage is applied is wound around a bobbin formed of resin material having a low dielectric constant and high insulating properties, and is hermetically sealed with this resin material.

The high-voltage and high-frequency insulation transformer of the present invention can be used in a power supply that insulates a high voltage electrically.

What is claimed is:

1. A high-voltage and high-frequency insulation transformer, comprising:

cores that each include legs that configure a magnetic path;

a plurality of windings that are wound and provided in the legs; and a bobbin that is formed of resin material having a low dielectric constant and high insulating properties, wherein from among the plurality of windings, a winding to which a high voltage is to be applied is wound around the bobbin and is hermetically sealed with insulating resin, so as to be integrally formed with the bobbin, and wherein the insulating resin has a thickness that satisfies a predetermined partial discharge inception voltage in an air space between one of the cores and the winding to which the high voltage is applied such that the thickness of the insulating resin is obtained for a two-layer dielectric model by Formula (1) below:

$$V_{pd}=\{d_1+(d_2/\varepsilon_r)\}\cdot V_p/d_1 \quad (1),$$

where $V_{pd}$ represents the predetermined partial discharge inception voltage [Vrms], $V_p$ represents a Paschen voltage [Vrms], $d_1$ represents a thickness of the air space, $d_2$ represents a thickness of the resin material, and $\varepsilon_r$ represents a relative dielectric constant of the resin material.

2. The high-voltage and high-frequency insulation transformer according to claim 1, wherein the insulating resin with which the winding is sealed hermetically includes a material identical to the resin material of which the bobbin is formed.

3. The high-voltage and high-frequency insulation transformer according to claim 1, wherein the insulating resin includes thermosetting resin having a low dielectric constant.

4. The high-voltage and high-frequency insulation transformer according to claim 3, wherein the insulating resin includes olefinic-cross-link-type dicyclopentadiene resin.

5. The high-voltage and high-frequency insulation transformer according to claim 1, wherein the insulating resin includes thermoplastic resin that has a low dielectric constant and is resistant to heat.

6. The high-voltage and high-frequency insulation transformer according to claim 5, wherein the insulating resin includes fluorocarbon resin or polystyrenic resin that has a low dielectric constant and is resistant to heat.

7. The high-voltage and high-frequency insulation transformer according to claim 1, wherein the bobbin includes a cylindrical portion that is formed at a center of the bobbin and flanges that extend from the cylindrical portion.

8. The high-voltage and high-frequency insulation transformer according to claim 7, wherein the winding to which the high voltage is to be applied is wound around the cylindrical portion and is hermetically sealed with the insulating resin in a space formed by the cylindrical portion and the flanges, so as to be integrally formed with the bobbin.

9. The high-voltage and high-frequency insulation transformer according to claim 1, wherein the winding to which the high voltage is to be applied is a primary winding.

10. The high-voltage and high-frequency insulation transformer according to claim 9, wherein a secondary winding includes one or more die-cut ring-shaped metal conductors.

11. The high-voltage and high-frequency insulation transformer according to claim 10, wherein the primary windings and the secondary windings are arranged from an end of the legs of one core of the cores to an end of the legs of another core of the cores in order of the secondary winding and the primary winding.

12. The high-voltage and high-frequency insulation transformer according to claim 11, wherein each of the primary windings is connected in series.

13. A high-voltage and high-frequency insulation transformer, comprising:

cores that each include legs that configure a magnetic path;

a plurality of windings that are wound and provided in the legs; and a bobbin that is formed of resin material having a low dielectric constant and high insulating properties, that includes a cylindrical portion formed at a center of the bobbin and flanges that extend from the cylindrical portion, wherein from among the plurality of windings, a winding to which a high voltage is to be applied is wound around the bobbin and is hermetically sealed with insulating resin, so as to be integrally formed with the bobbin, wherein the insulating resin has a thickness that satisfies a predetermined partial discharge inception voltage in an air space between one of the cores and the winding to which the high voltage is applied such that the thickness of the insulating resin is obtained for a two-layer dielectric model by Formula (1) below:

$$V_{pd}=\{d_1+(d_2/\varepsilon_r)\}\cdot V_p/d_1 \quad (1),$$

where $V_{pd}$ represents the predetermined partial discharge inception voltage [Vrms], $V_p$ represents a Paschen voltage [Vrms], $d_1$ represents a thickness of the air space, $d_2$ represents a thickness of the resin material, and $\varepsilon_r$ represents a relative dielectric constant of the resin material, wherein said winding to which a high voltage is to be applied is a primary winding and is wound around the cylindrical portion of the bobbin and is hermetically sealed with the insulating resin in a space formed by the cylindrical portion and the flanges, and wherein, from among the plurality of windings, a secondary winding includes one or more die-cut ring-shaped metal conductors.

14. A high-voltage and high-frequency insulation transformer, comprising:

cores that each include legs that configure a magnetic path;

a plurality of windings that are wound and provided in the legs; and a bobbin that is formed of resin material having a low dielectric constant and high insulating properties, wherein from among the plurality of windings, a winding to which a high voltage is to be applied is a primary winding and is wound around the bobbin and is hermetically sealed with insulating resin, so as to be integrally formed with the bobbin, and wherein the insulating resin with which the winding is sealed hermetically includes a material identical to the resin material of which the bobbin is formed and comprises a thermosetting resin having a low dielectric constant, wherein the insulating resin has a thickness that satisfies a predetermined partial discharge inception voltage in an air space between one of the cores and the winding to which the high voltage is applied such that the thickness of the insulating resin is obtained for a two-layer dielectric model by Formula (1) below:

$$V_{pd}=\{d_1+(d_2/\varepsilon_r)\}\cdot V_p/d_1 \quad (1),$$

where $V_{pd}$ represents the predetermined partial discharge inception voltage [Vrms], $V_p$ represents a Paschen voltage [Vrms], $d_1$ represents a thickness of the air space, $d_2$ represents a thickness of the resin material, and $\varepsilon_r$ represents a relative dielectric constant of the resin material, and wherein, from among the plurality of windings, another winding to which a low voltage is to be applied includes one or more die-cut ring-shaped metal conductors.

15. The high-voltage and high-frequency insulation transformer according to claim 14, wherein the insulating resin includes olefinic-cross-link-type dicyclopentadiene resin.

* * * * *